US011513551B2

(12) United States Patent
Cadima

(10) Patent No.: US 11,513,551 B2
(45) Date of Patent: Nov. 29, 2022

(54) COOKING APPLIANCE AND KNOB ASSEMBLY FOR PREVENTING ACCIDENTAL ENGAGEMENT

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 107 days.

(21) Appl. No.: 17/168,637

(22) Filed: Feb. 5, 2021

(65) Prior Publication Data

US 2022/0253088 A1 Aug. 11, 2022

(51) Int. Cl.

| | |
|---|---|
| ***G05G 1/10*** | (2006.01) |
| ***G05G 5/00*** | (2006.01) |
| ***F24C 3/12*** | (2006.01) |
| ***F24C 7/08*** | (2006.01) |
| ***G05G 1/08*** | (2006.01) |

(52) U.S. Cl.

CPC ..... *G05G 5/005* (2013.01); *F24C 3/128* (2013.01); *F24C 7/085* (2013.01); *G05G 1/082* (2013.01); *G05G 1/10* (2013.01); *G05G 2505/00* (2013.01)

(58) Field of Classification Search

CPC ..... G05G 1/08; G05G 1/082; G05G 1/087; G05G 1/10; G05G 1/12; F24C 3/12; F24C 3/122; F24C 3/124; F24C 3/126; F24C 7/08; F24C 7/081; F24C 7/082

See application file for complete search history.

(56) References Cited

U.S. PATENT DOCUMENTS

| | | | | |
|---|---|---|---|---|
| 5,048,365 | A * | 9/1991 | Webb | G05G 1/082 74/553 |
| 5,771,878 | A * | 6/1998 | Lewis | G05G 1/02 431/153 |
| 2007/0187215 | A1* | 8/2007 | Lavigne | H01H 3/20 200/4 |
| 2016/0329175 | A1* | 11/2016 | Bowen | F24C 7/082 |

(Continued)

FOREIGN PATENT DOCUMENTS

| | | | |
|---|---|---|---|
| CN | 105674349 | B | 2/2018 |
| EP | 3462092 | A1 | 4/2019 |

(Continued)

*Primary Examiner* — Brian J McGovern

(74) *Attorney, Agent, or Firm* — Dority & Manning, P.A.

(57) ABSTRACT

A cooking appliance or knob assembly may include a surface panel, a knob switch, a support plate, a control body, a central projection, and a spacing stake. The knob switch may be disposed behind the surface panel. The knob switch may include an internal spring and a slidable stem extending through a central axis. The slidable stem may be in forward-biased mechanical communication with the internal spring. The support plate may be rotabably mounted about the slidable stem. The control body may be mounted to the slidable stem. The control body may be rotationally fixed to the support plate and slidable relative thereto. The control body may include a primary grip extending about at least a portion of the slidable stem. The central projection may be disposed radially inward from the primary grip and define an axially fixed stop surface disposed forward from the control body.

20 Claims, 7 Drawing Sheets

(56) References Cited

U.S. PATENT DOCUMENTS

| | | | | |
|---|---|---|---|---|
| 2017/0227231 | A1* | 8/2017 | Pionek | F24C 3/124 |
| 2017/0235328 | A1* | 8/2017 | Swayne | G05G 5/005 74/532 |
| 2018/0080657 | A1* | 3/2018 | Billman | F24C 3/103 |
| 2019/0346145 | A1* | 11/2019 | Moon | F16K 31/44 |
| 2020/0103119 | A1* | 4/2020 | Kim | F24C 7/082 |
| 2020/0149745 | A1 | 5/2020 | Chang | |
| 2020/0300475 | A1* | 9/2020 | Ibrahim | G05G 1/082 |
| 2021/0265120 | A1* | 8/2021 | Marcotte | H01H 19/08 |
| 2021/0286396 | A1* | 9/2021 | Izumi | G06F 3/0312 |
| 2022/0049850 | A1* | 2/2022 | Cadima | F24C 15/34 |

FOREIGN PATENT DOCUMENTS

| | | | |
|---|---|---|---|
| EP | 3505829 | A1 | 7/2019 |
| KR | 0135812 | Y1 | 3/1999 |

* cited by examiner

COOKING APPLIANCE AND KNOB ASSEMBLY FOR PREVENTING ACCIDENTAL ENGAGEMENT

FIELD OF THE INVENTION

The present subject matter relates generally to control knobs on an appliance, such as a cooking appliance. More particularly, the present subject matter relates to an improved assembly for control knobs having one or more features for preventing accidental engagement.

BACKGROUND OF THE INVENTION

Knobs are commonly used on a variety of commercial and residential appliances to control an operating condition of the appliance. Knobs are particularly common on cooking appliances, such as stoves or cooktops. Various shapes and sizes can be used depending upon, for example, the intended application, aesthetics, and other factors.

For example, cooking appliances that include a cooktop traditionally have at least one heating element positioned on a panel proximate a cooktop surface for use in heating or cooking an object, such as a cooking utensil, and its contents. The heating element can operate to heat a cooking utensil directly through induction heating, or may use another heat source such as electrically resistant coils or gas burners. Commonly, one knob corresponds to one or more heating elements such that rotation of the knob activates, ignites, or otherwise adjusts heat generated at the corresponding heating elements. In order to prevent accidental or inadvertent activation of the corresponding heating elements, many knobs require a compound movement to activate or ignite the heating elements from rest (e.g., a state in which no heat is being generated at the heating elements or no fuel is being flowed to the same). For instance, a valve or switch box to which the knob is connected may force the knob to be pushed inward before the knob can be rotated (e.g., to adjust the volume of fuel flowed to the heating element or otherwise alter the heat generated at the heating elements).

Certain drawbacks exist with these existing constructions, however. For instance, such constructions can place undesired strain on the internal valve or switch box to which the knob is connected. Moreover, existing constructions may still be susceptible to accidental activation that may occur, for instance, when a user leans on the knob and subsequently moves such that the knob is rotated.

As a result, further improvements to knob assemblies would be useful. In particular, it would be advantageous to provide a knob assembly or appliance having one or more features for preventing accidental activation (e.g., while mitigating or reducing strain on an internal valve or switch-box).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a knob assembly for an appliance is provided. The knob assembly may include a surface panel, a knob switch, a support plate, a control body, a central projection, and a spacing stake. The surface panel may have a forward face and a rearward face. The surface panel may define a central axis through the surface panel from the rearward face to the forward face. The knob switch may be disposed behind the surface panel. The knob switch may include an internal spring and a slidable stem extending through the central axis. The slidable stem may be in forward-biased mechanical communication with the internal spring. The support plate may be rotabably mounted in front of the forward face about the slidable stem. The control body may be mounted to the slidable stem. The control body may be rotationally fixed to the support plate and slidable relative thereto. The control body may include a primary grip extending about at least a portion of the slidable stem and radially outward therefrom. The central projection may be disposed radially inward from the primary grip. The central projection may define an axially fixed stop surface disposed forward from the control body. The spacing stake may extend rearward from the central projection through the control body toward the forward face.

In another exemplary aspect of the present disclosure, a cooking appliance is provided. The cooking appliance may include a cabinet, a heating element, a surface panel, a knob switch, a support plate, a control body, a central projection, and a spacing stake. The heating element may be mounted to the cabinet. The surface panel may be mounted to the cabinet forward from the heating element, the surface panel defining a central axis therethrough. The knob switch may be disposed behind the surface panel. The knob switch may include an internal spring and a slidable stem extending through the central axis. The slidable stem may be in forward-biased mechanical communication with the internal spring. The support plate may be rotabably mounted in front of the forward face about the slidable stem. The control body may be mounted to the slidable stem. The control body may be rotationally fixed to the support plate and slidable relative thereto. The control body may include a primary grip extending about at least a portion of the slidable stem and radially outward therefrom. The central projection may be disposed radially inward from the primary grip. The central projection may define an axially fixed stop surface disposed forward from the control body. The spacing stake may extend rearward from the central projection through the control body toward the forward face.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
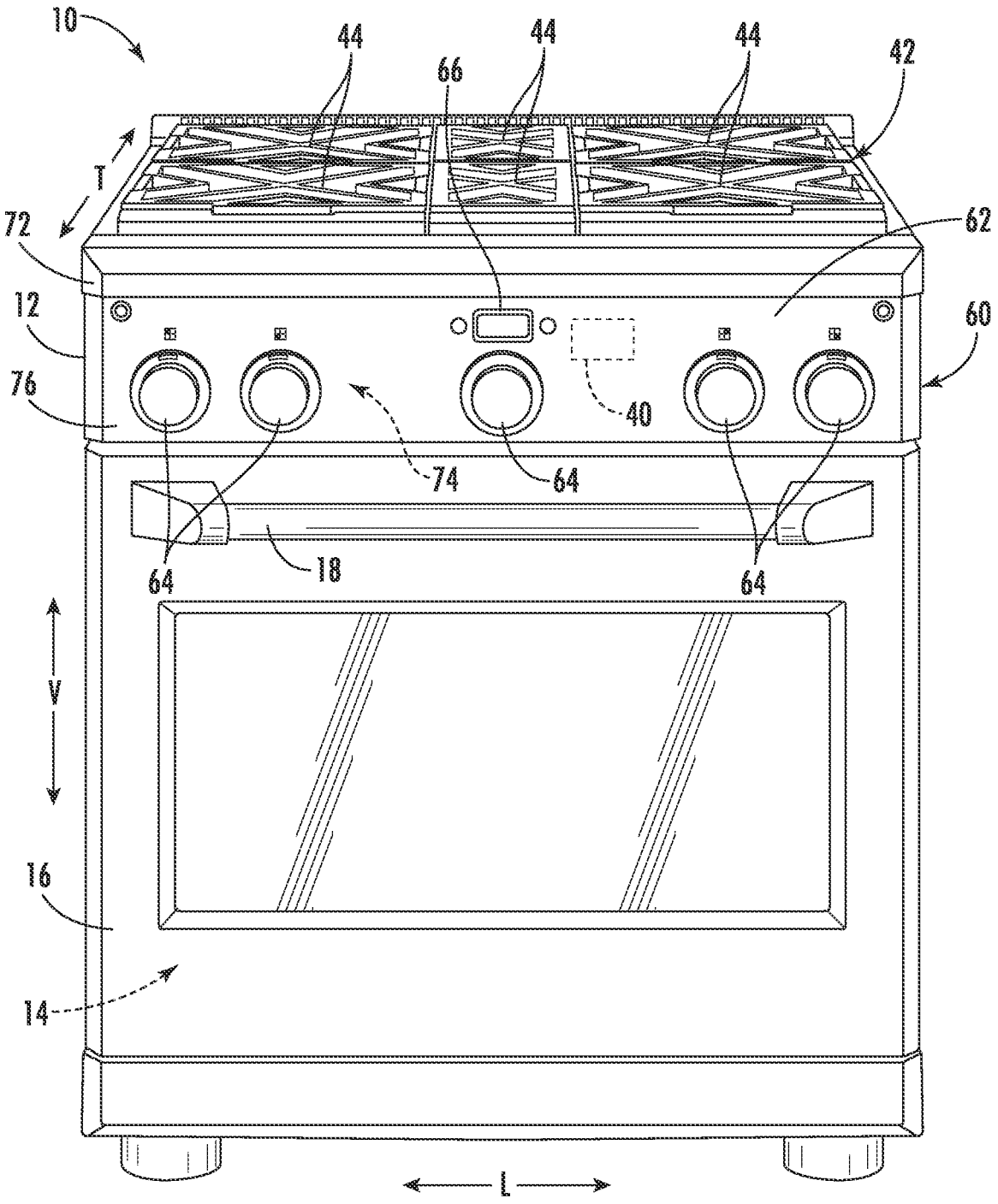
FIG. 1 provides a perspective view of a cooking appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
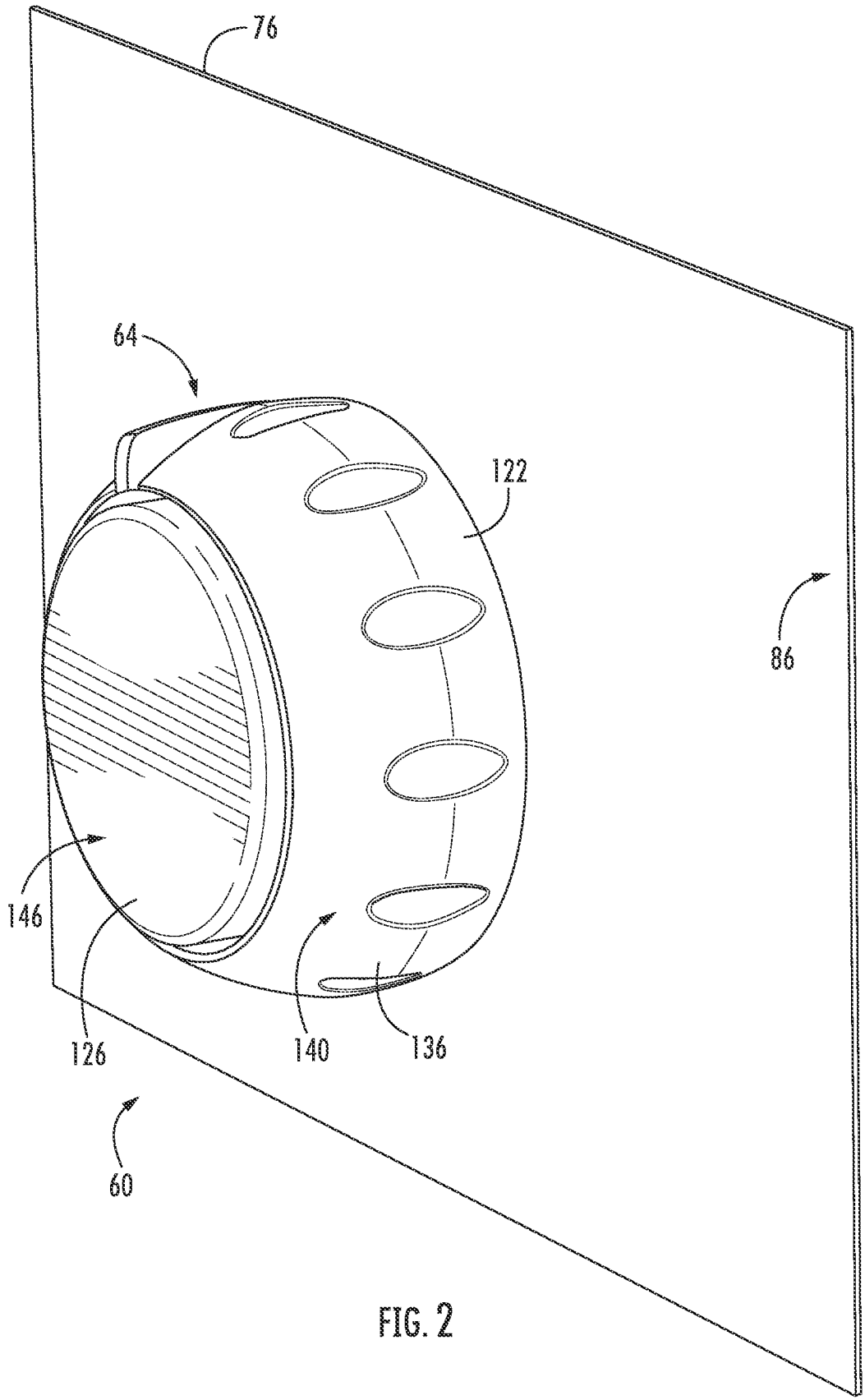
FIG. 2 provides a magnified view of a portion of the control panel of the exemplary cooking appliance of FIG. 1, including a knob assembly.

Turning now to the figures, FIG. 1 provides a perspective view of a cooking appliance, such as an oven appliance 10, according to exemplary embodiments of the present disclosure. FIG. 2 provides a magnified perspective view of a portion of a control panel of oven appliance 10. Generally, oven appliance 10 defines a vertical direction V, a lateral direction L, and a transverse direction T. The vertical direction V, lateral direction L, and transverse direction T are mutually perpendicular and form an orthogonal direction system. As will be understood, oven appliance 10 is provided by way of example only, and the present subject matter may be used in any suitable appliance. Thus, the present disclosure may be used with other oven, range, or cooktop appliance configurations (e.g., configurations that define multiple interior cavities for the receipt of food, include no interior cavities, or are otherwise different than the configuration shown in FIG. 1), as well as other suitable appliances, as would be understood in light of the present disclosure.

Oven appliance 10 includes an insulated cabinet 12 with an interior cooking chamber 14 defined by an interior surface of cabinet 12. Cooking chamber 14 is configured for the receipt of one or more food items to be cooked. Oven appliance 10 includes a door 16 rotatably mounted to cabinet 12 (e.g., with a hinge—not shown). A handle 18 may be mounted to door 16 and may assist a user with opening and closing door 16 in order to access an opening to cooking chamber 14. For example, a user can pull on handle 18 to open or close door 16 and access cooking chamber 14 through the opening. As would be understood, one or more internal heating elements (e.g., baking or broiling heating elements) may be provided within cooking chamber 14 to cook or otherwise heat items therein.

Oven appliance 10 can include a seal (not shown) between door 16 and cabinet 12 that assist with maintaining heat and cooking fumes within cooking chamber 14 when door 16 is closed, as shown in FIG. 1. One or more parallel glass panes 22 provide for viewing the contents of cooking chamber 14 when door 16 is closed and assist with insulating cooking chamber 14. Optionally, a baking rack (not pictured) is positioned in cooking chamber 14 for the receipt of food items or utensils containing food items.

In some embodiments, oven appliance 10 includes a cooktop surface 42 having one or more heating elements 44 for use in heating or cooking operations. In exemplary embodiments, cooktop surface 42 is comprised of metal (e.g., steel) panel on which one or more grates may be supported. In other embodiments, however, cooktop surface 42 may be comprised of another suitable material, such as a ceramic glass or another suitable non-metallic material. Heating elements 44 may be various sizes, as shown in FIG. 1, and may employ any suitable method for heating or cooking an object, such as a cooking utensil (not shown), and its contents. In one embodiment, for example, heating element uses a heat transfer method, such as electric coils or gas burners, to heat the cooking utensil. In another embodiment, however, heating element 44 uses an induction heating method to heat the cooking utensil directly. In turn, heating element may include a burner element, electric heat element, induction element, or another suitable heating element.

Some embodiments of oven appliance 10 include a controller 40 (e.g., configured to control one or more operations of oven appliance 10). For example, controller 40 may control at least one operation of oven appliance 10 that includes an internal heating element or cooktop heating element 44. Controller 40 may be in communication (via for example a suitable wired or wireless connection) with one or more of heating element(s) 44 and other suitable components of oven appliance 10, as discussed herein. In general, controller 40 may be operable to configure oven appliance 10 (and various components thereof) for cooking. Such configuration may be based, for instance, on a plurality of cooking factors of a selected operating cycle or mode.

By way of example, controller 40 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 40 may be positioned in a variety of locations throughout oven appliance 10. As illustrated, controller 40 may be located within a user interface 62 of oven appliance 10. In some such embodiments, input/output ("I/O") signals may be routed between controller 40 and various operational components of oven appliance 10, such as heating element (s) 44, control knobs 64, display component 66, sensors, alarms, or other components as may be provided. For instance, signals may be directed along one or more wiring harnesses that may be routed through cabinet 12. In some embodiments, controller 40 is in communication with user interface assembly 62 and control knobs 64 through which a user may select various operational features and modes and monitor progress of oven appliance 10. In one embodiment, user interface assembly 62 may represent a general purpose I/O ("GPIO") device or functional block. In one embodiment, user interface assembly 62 may include input components, such as one or more of a variety of electrical, mechanical, or electro-mechanical input devices including rotary dials, push buttons, and touch pads. User interface assembly 62 may include a display component 66, such as a digital or analog display configured to provide operational feedback to a user.

During use of oven appliance 10, the amount of heat delivered by each heating element 44 on cooktop 42 may be controlled by controller 40 and a corresponding knob assembly 60, described in detail below. For instance, knob assembly 60 may include one or more control knobs 64 mounted (e.g., rotatably) on a surface panel 76 of user interface 62 forward from heating elements 44 (e.g., along or relative to the transverse direction T). Each control knob 64 may correspond to a discrete heating element 44. Control knob 64, as used herein, refers to any configuration of dial, and not just one having a circular base shape. For example, the present disclosure contemplates exemplary embodiments wherein control knobs 64 have a rectangular base shape, an ovular base shape, or any other shape having one or more curved lines, straight lines, or both.

Figure 3:
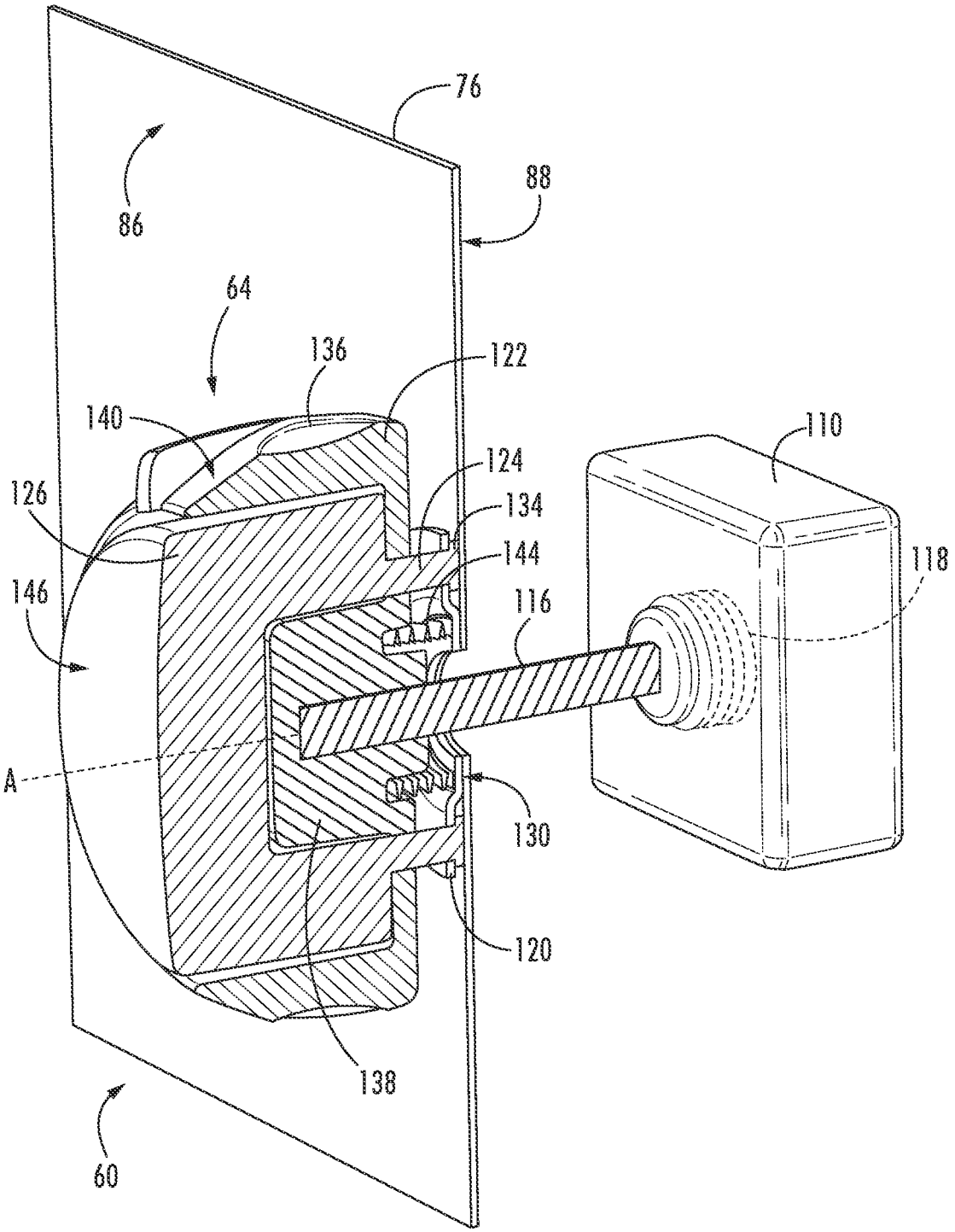
FIG. 3 provides a sectional perspective view of the exemplary control panel portion of FIG. 2.
Figure 4:
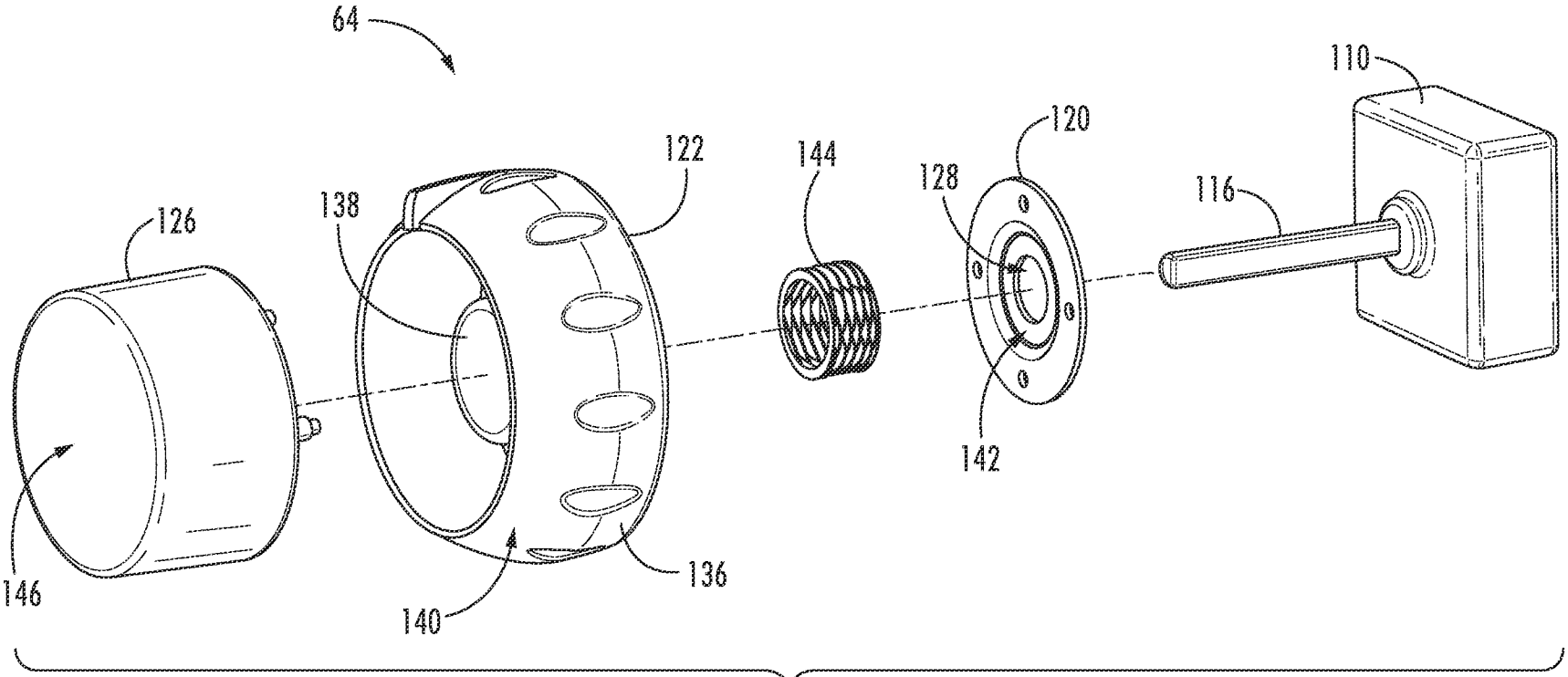
FIG. 4 provides an exploded perspective view of a portion of the exemplary knob assembly of FIG. 2.
Figure 5:
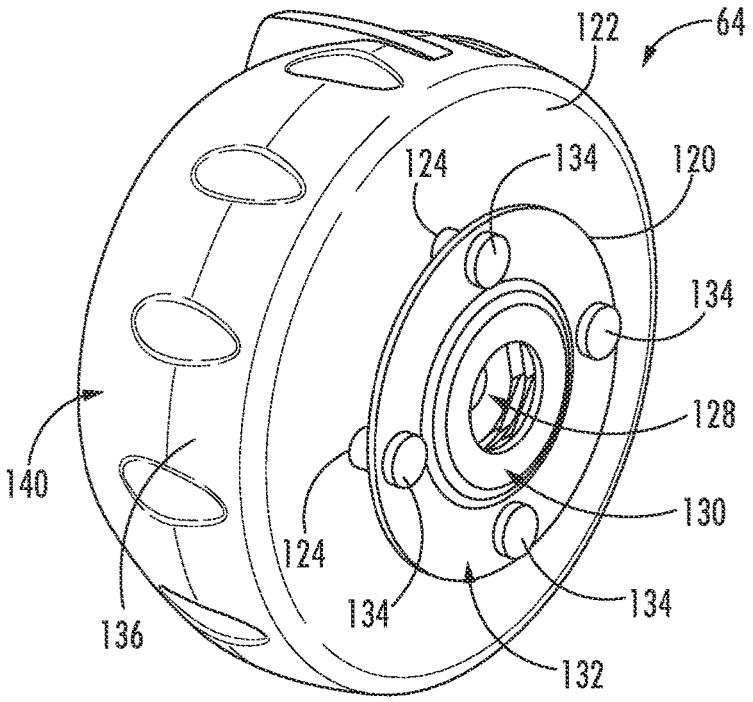
FIG. 5 provides a rear perspective view of a portion of the exemplary knob assembly of FIG. 2.
Figure 6:
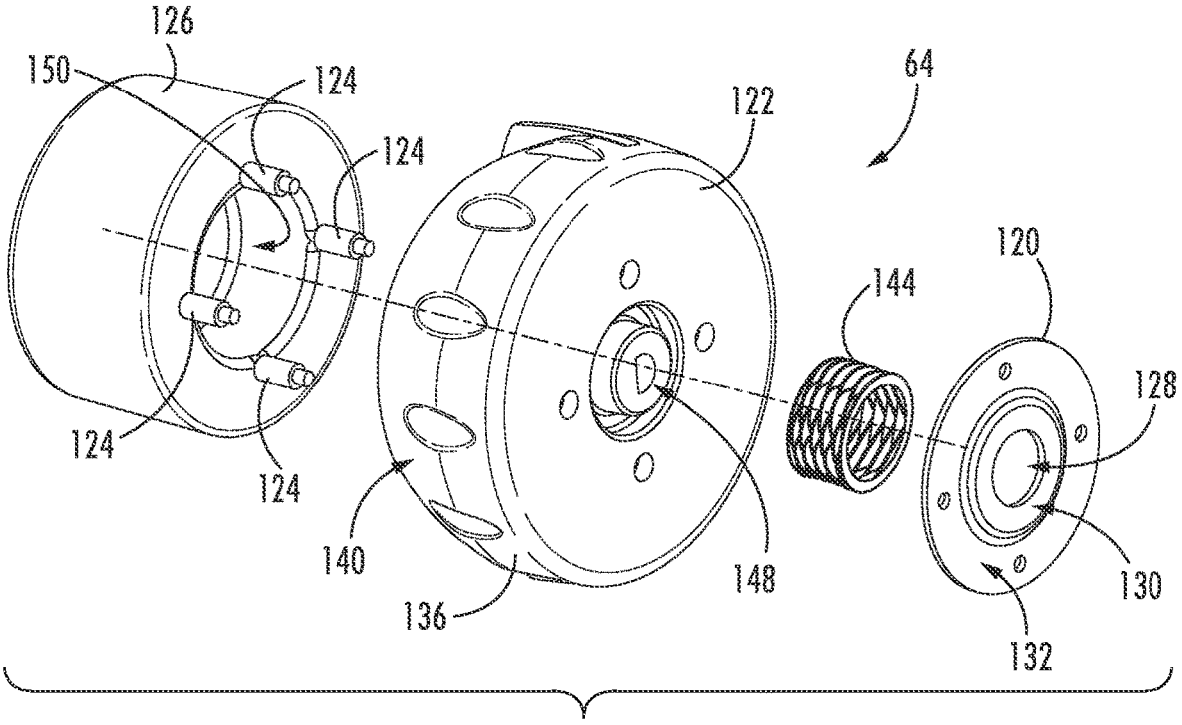
FIG. 6 provides an exploded perspective view of the portion of the exemplary knob assembly of FIG. 5.
Figure 8:
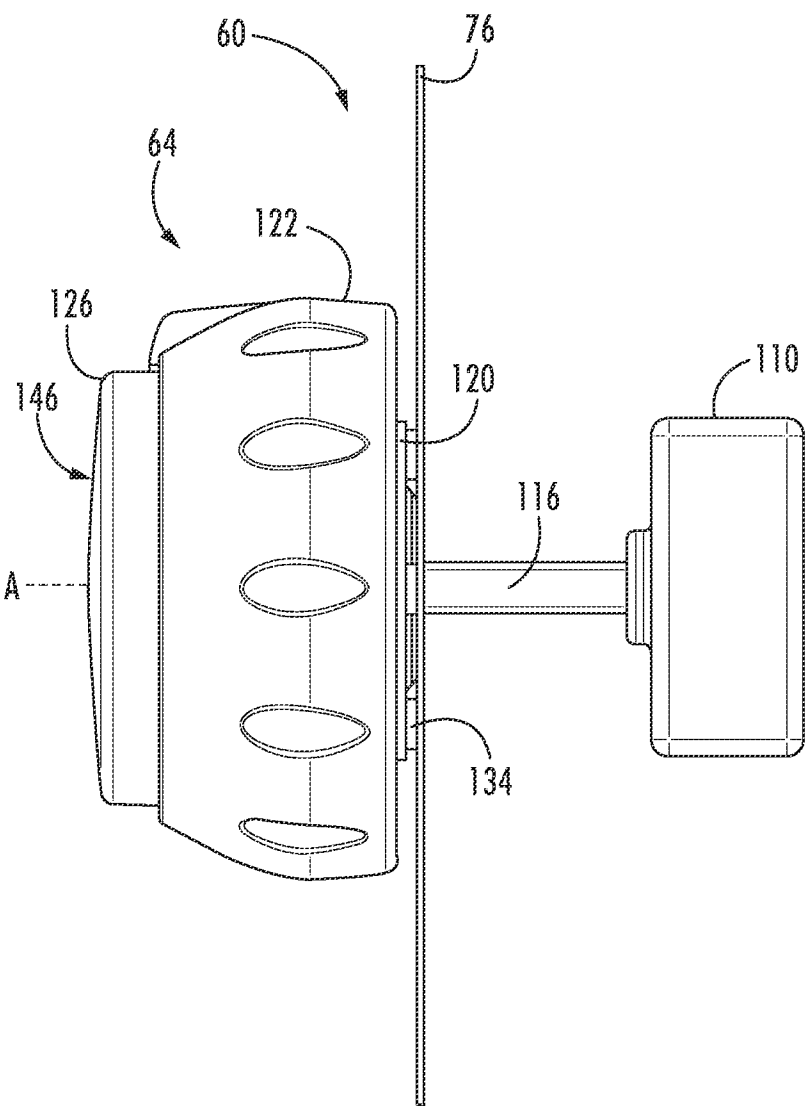
FIG. 8 provides a side perspective view of the exemplary knob assembly of FIG. 2, wherein the knob assembly is in an adjustable state.
Figure 7:
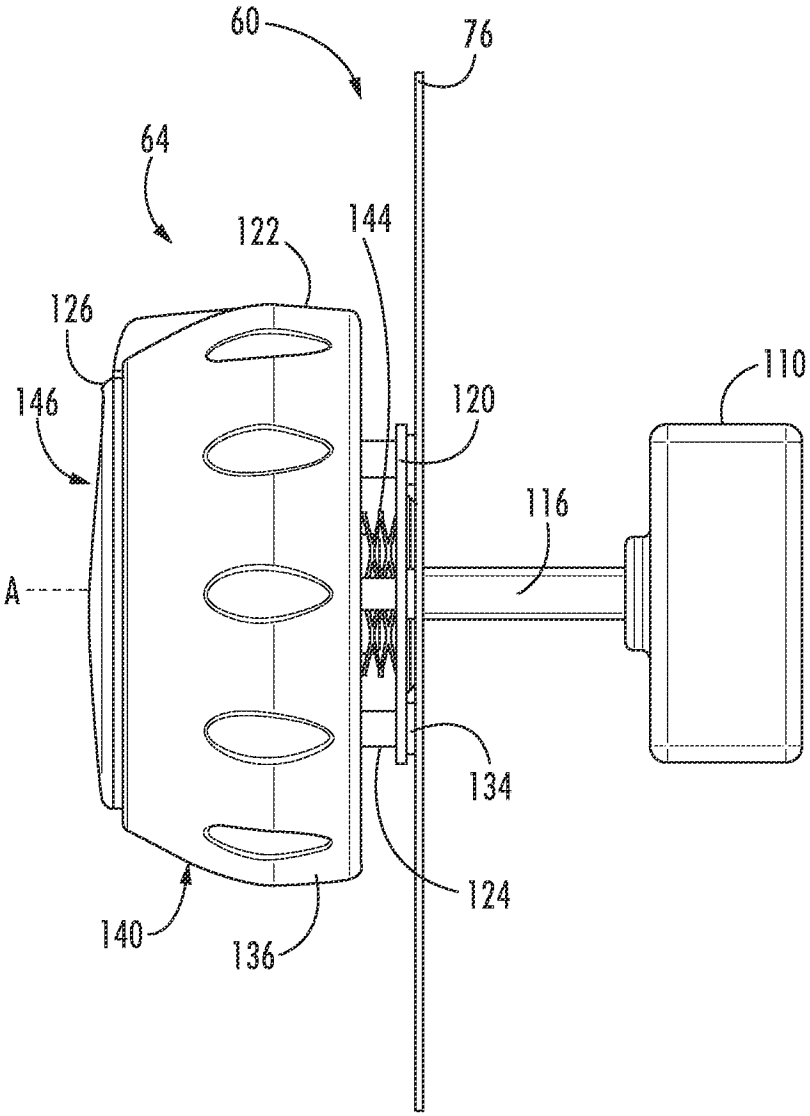
FIG. 7 provides a side perspective view of the exemplary knob assembly of FIG. 2, wherein the knob assembly is in a static state.
Figure 10:
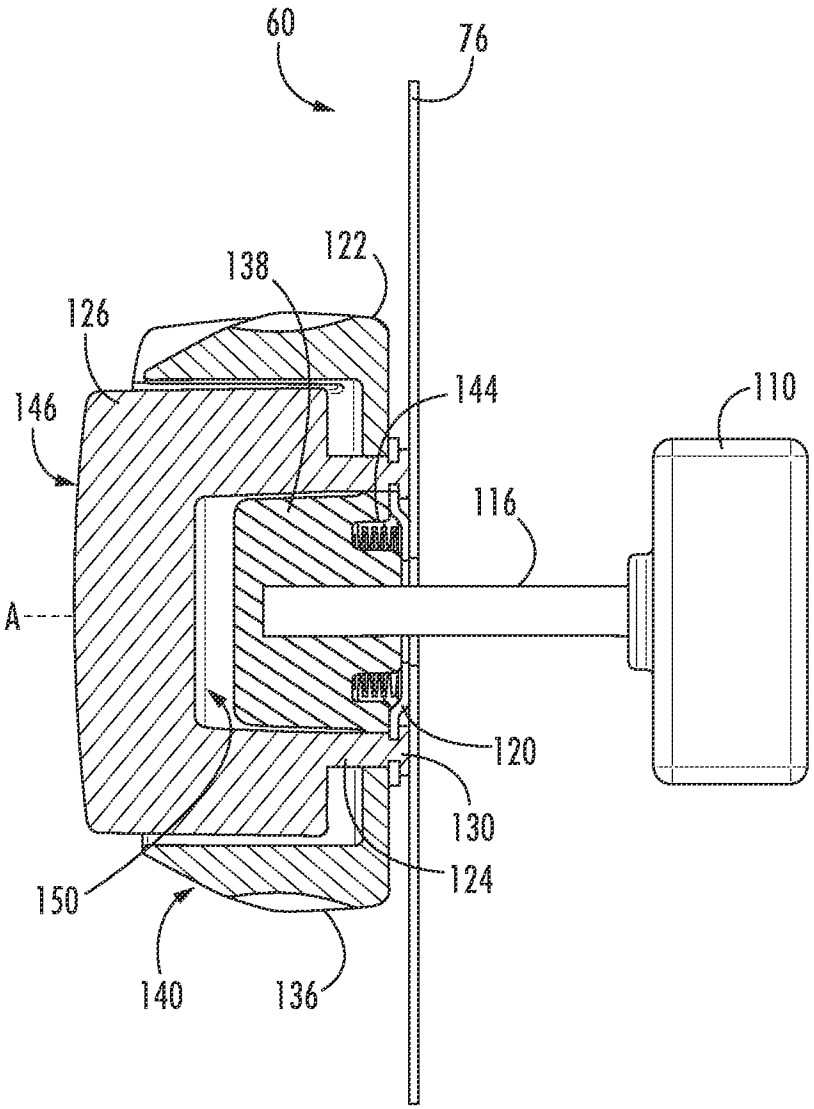
FIG. 10 provides a side sectional view of the exemplary knob assembly of FIG. 2, wherein the knob assembly is in an adjustable state.
Figure 9:
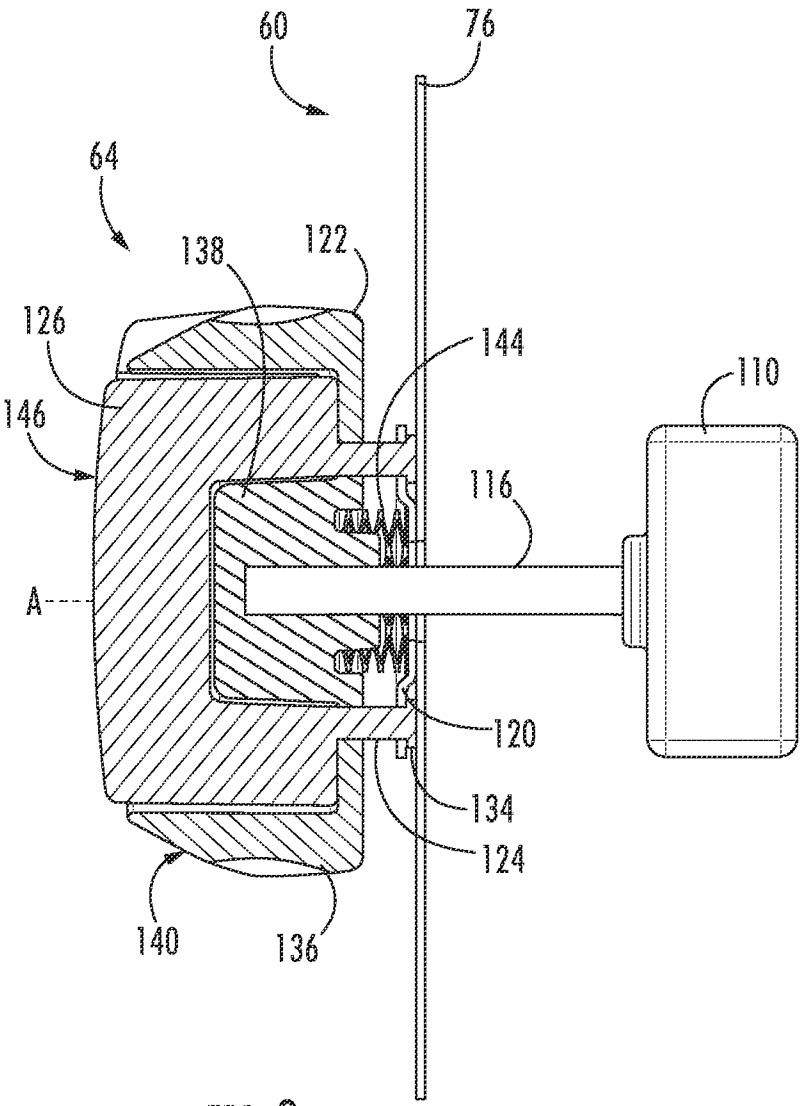
FIG. 9 provides a side sectional view of the exemplary knob assembly of FIG. 2, wherein the knob assembly is in a static state.

Turning now to FIGS. 2 through 10, various views are provided of a particular knob assembly 60 (e.g., including one knob 64) and portions thereof, such as might be provided at knob assembly 60 in FIGS. 1 and 2. FIG. 3 provides a sectional perspective view, similar in viewing angle to FIG. 2. FIG. 4 provides an exploded perspective view of knob assembly 60. FIGS. 5 and 6 provide rear perspective views of knob 64 in both an assembled and an exploded view, respectively. FIGS. 7 and 8 provide side perspective views of knob assembly 60 in a static state and an adjustable state, respectively. Similarly, FIGS. 9 and 10 provide side sectional views of knob assembly 60 in the static state and the adjustable state, respectively.

As shown, knob assembly 60 may include a knob switch 110 and control knob 64, which are connected to each other and mounted on surface panel 76. In some embodiments, surface panel 76 defines one or more axes or openings to permit mechanical or electrical connections between portions of knob assembly 60 or controller 40 (e.g., within cabinet 12). For instance, surface panel 76 may define a central axis A through an opening extending from a rearward face 88 to a forward face 86 of surface panel 76. Knob switch 110 may be disposed behind surface panel 76 while control knob 64 is disposed in front of surface panel 76.

Generally, knob switch 110 may include a suitable mechanical valve or electrical switch in communication with a slidable input stem 116 and internal spring 118 of knob switch 110, as would be understood. For instance, the slidable stem 116 may be extend from a switch body (e.g., through surface panel 76) to form part of a suitable input mechanism for controlling a valve position or detecting and communicating a signal relating to the rotational position of control knob 64 (e.g., a potentiometer, digital encoder, etc.). Internal spring 118 may bias slidable stem 116 forward. During use, rotation of control knob 64 and the input stem about the central axis A may alternately increase or decrease a voltage signal and, in turn, alternately increase or decrease an output of a heating element (e.g., heating element 44), as would be understood. Moreover, as would further be understood, internal spring 118 may be in forward-biased mechanical communication with the slidable stem 116 to require rearward translation of slidable stem 116 to permit subsequent rotation. Thus, after initially pushing slidable stem 116 rearward, slidable stem 116 may be permitted to rotate freely (e.g., within a predefined angle or circumferential path).

In some embodiments, control knob 64 includes various components that are generally mounted along and about a portion of central axis A (e.g., to direct the rotational position of slidable stem 116). Specifically, control knob 64 may include a support plate 120 that is rotatably mounted about the slidable stem 116 in front of the forward face 86. A control body 122 having or defining a primary grip 136 may be rotationally fixed to the support plate 120 (e.g., while being slidable relative to the same). A central projection 126 may be disposed radially inward from the primary grip 136 (e.g., across the central axis A) and one or more spacing stakes 124 may extend rearward from the central projection 126 through the control body 122 toward the forward face 86.

As shown, support plate 120 may be held in place or otherwise secured to the rest of knob 64 by the spacing stakes 124. Thus, the spacing stakes 124 may be fixed to support plate 120 (e.g., to rotate with fixed support plate 124 and the rest of knob 64). When assembled, support plate 120 may be permitted to rotate relative to surface panel 76 while being axially static. In other words, support plate 120 may function to rotate about the central axis A, but maintain a constant axial position relative to the central axis A. In some such embodiments, support plate 120 includes a contact surface 130 disposed on or against forward face 86 about a center hole 128 that is coaxial with central axis A. Optionally, a rear gapped surface 132 may extend forward from contact surface 130 (e.g., radially outward from contact surface 130) such that the rear gapped surface 132 is spaced apart from and forms a gap with the forward face 86. One or more stake holes may be defined through the rear gapped surface 132 to permit the spacing stakes 124 to each extend through a corresponding stake hole. A flared mounting foot 134 (e.g., cap or rivet) may be attached to or formed with each spacing stake 124 at the rear gapped surface 132. The mounting foot 134 of each spacing stake 124 may thus be sandwiched between the forward face 86 and the rear gapped surface 132 (e.g., in contact with the forward face 86).

Control body 122 may generally be disposed in front of support plate 120. Specifically, control body 122 may be mounted to slidable stem 116 to move therewith. Thus, control body 122 may be slidable relative to support plate 120. Moreover, control body 122 may be rotationally fixed to support plate 120 such that rotation of control body 122 and slidable stem 116 may also rotate support plate 120. For instance, the spacing stakes 124 extending through control body 122 may be rotated by control body 122 and thereby direct rotation of support plate 120 too.

As noted above, control body 122 may include a primary grip 136 that extends about at least a portion of the slidable stem 116. In particular, primary grip 136 may be radially spaced apart or outward from slidable stem 116 to permit a user to easily grasp control body 122. For instance, a center cap 138 of control body 122, which is disposed radially inward from primary grip 136, may bridge the radial space between slidable stem 116 and primary grip 136 (e.g., behind the central projection 126). In certain embodiments, center cap 138 extends across the central axis A. Moreover, center cap 138 may provide an attachment surface or structure to connect control body 122 to slidable stem 116. For instance, center cap 138 may define a keyed slot 148 that is matched to the slidable stem 116. In other words, the shape of keyed slot 148 may form the negative of the non-circular profile shape of the slidable stem 116 such that the keyed slot can receive the slidable stem 116 and be rotated by the same.

In certain embodiments, the primary grip 136 has an axially curved or at least partially non-cylindrical shape. Thus, at least a portion of the outer surface of primary grip 136 may provide a segment or surface that is not parallel to the central axis A. As an example, primary grip 136 may include a domed segment 140 (e.g., as a forwardmost surface of primary grip 136 or control body 122, generally). As shown, domed segment 140 may be tapered forward and radially inward, such as to or toward the central projection 126. A user may, in turn, notably push the domed segment 140 toward the surface panel 76 while also being able to radially act on the domed segment 140 and rotate primary grip 136 generally.

When assembled, control body 122 may be biased forward from or at a point apart from slidable stem 116. For instance, an external spring 144 may be disposed between support plate 120 and control body 122. Specifically, control body 122 may be in forward-biased mechanical communication with external spring 144. A front indentation 142 may be defined by support plate 120 (e.g., opposite of contact surface 130) to receive external spring 144 and axially align the same. As shown, external spring 144 may be formed or provided as a coiled compression spring (e.g., to bias control body 122 forward relative to support plate 120). Nonetheless, any suitable spring structure (e.g., leaf spring, sponge spring, torsion spring, etc.) may be provided between support plate 120 and control body 122. In turn, external spring 144 may further bias control body 122 toward a static state, even after a user has axially depressed control body 122 to a rearward adjustable state wherein control body 122 and slidable stem 116 may be rotated. Since slidable stem 116 is generally fixed relative to control body 122, axial movement of control body 122 between the static and adjustable states may similarly move slidable stem 116 (e.g., relative to surface panel 76 or the switch box of knob switch 110, which houses internal spring 118 and a valve or electronic switch, as is understood).

Separate from control body 122, a central projection 126 may be included with knob assembly 60. Specifically, central projection 126 may be disposed radially inward from the primary grip 136. Central projection 126 may be an axially static member that is not permitted to slide with slidable stem 116 relative to surface panel 76. Additionally or alternatively, central projection 126 may define a stop surface 146 that is disposed forward from control body 122 (e.g., the entirety of control body 122). As shown, stop surface 146 may be the forwardmost surface of control knob 64, even when control body 122 is in the static state. Thus, a solid mass, such as a user's waist or midsection, that is moved toward knob assembly 60 may primarily contact stop surface 146, thereby preventing the mass's or user's engagement with control body 122. By contrast, a user may still be able to grasp control body 122 around central projection 126.

In certain embodiments, at least a portion of the central projection 126 is disposed in front of center cap 138 even while being radially bounded by at least a portion of primary grip 136. For instance, central projection 126 may define a rear recess 150 within which center cap 138 is selectively received (e.g., as control body 122 slides forward and rearward towards the static state and the adjustable state, respectively). As noted above, the spacing stakes 124 may extend rearward from central projection 126 (e.g., while being circumferentially spaced apart about the central axis A). In some such embodiments, the spacing stakes 124 maintain the axially spacing and position of central projection 126 relative to surface panel 76.

During use, a user may activate or ignite a heating element (e.g., 44) from a rest state by grasping a corresponding control knob 64 at the primary grip 136 in the static state. Specifically, the user may push against the domed segment 140 to push control body 122 rearward toward the adjustable state. As control body 122 is pushed rearward, slidable stem 116 may also slide rearward into the switch box of knob switch 110, thereby compressing internal spring 118 and external spring 144. As shown, central projection 126 may remain axially static even as control body 122 moves rearward to the adjustable state. In the adjustable state, control body 122 and slidable stem 116 may be permitted to rotate to activate, ignite, or otherwise vary heat generated at the corresponding heating element. Once a user has completed adjustment of the heat (e.g., moved the knob 64 to a desired setting or rotational position), the user may release the primary grip 136, thereby allowing external spring 144 to motivate control body 122 forward (e.g., back to the static state).

Advantageously, an appliance (e.g., appliance 10) or knob assembly (e.g., knob assembly 60) in accordance with the present disclosure may prevent accidental activation of a corresponding heating element. Additionally or alternatively, the disclosed appliance or knob assembly may advantageously mitigate or reduce strain on a corresponding knob switch (e.g., knob switch 110), such as might increase the life or reliability of the knob switch.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A knob assembly for an appliance, the knob assembly comprising:

a surface panel having a forward face and a rearward face, the surface panel defining a central axis through the surface panel from the rearward face to the forward face;

a knob switch disposed behind the surface panel, the knob switch comprising an internal spring and a slidable stem extending through the central axis, the slidable stem being in forward-biased mechanical communication with the internal spring;

a support plate rotabably mounted in front of the forward face about the slidable stem;

a control body mounting to the slidable stem, the control body being rotationally fixed to the support plate and slidable relative thereto, the control body comprising a primary grip extending about at least a portion of the slidable stem and radially outward therefrom;

a central projection disposed radially inward from the primary grip, the central projection defining an axially fixed stop surface disposed forward from the control body; and a spacing stake extending rearward from the central projection through the control body toward the forward face.

2. The knob assembly of claim 1, further comprising an external spring disposed between the support plate and the control body, the control body being in forward-biased mechanical communication with the external spring.

3. The knob assembly of claim 2, wherein the support plate defines a front indentation receiving the external spring.

4. The knob assembly of claim 1, wherein the primary grip comprises a domed segment tapered forward and radially inward toward the central projection.

5. The knob assembly of claim 1, wherein the spacing stake is one stake of a plurality of spacing stakes extending rearward from the central projection and circumferentially spaced apart about the rotation axis.

6. The knob assembly of claim 5, wherein each spacing stake of the plurality of spacing stakes is fixed to the support plate to rotate therewith.

7. The knob assembly of claim 1, wherein the control body comprises a center cap disposed radially inward from the primary grip and behind the central projection.

8. The knob assembly of claim 7, wherein the central projection defines a rear recess receiving the center cap therein.

9. The knob assembly of claim 7, wherein the center cap defines a keyed slot matched to the slidable stem to be rotated thereby, the slidable stem being received within the keyed slot.

10. The knob assembly of claim 1, wherein the support plate defines a rear contact surface disposed on the forward face and a rear gapped surface spaced apart from the forward face radially outward from the rear contact surface, and wherein the spacing stake comprising a mounting foot disposed between the rear contact surface and the forward face.

11. A cooking appliance comprising:

a cabinet;

a heating element mounted to the cabinet;

a surface panel mounted to the cabinet forward from the heating element, the surface panel defining a central axis therethrough;

a knob switch disposed behind the surface panel and corresponding to the heating element, the knob switch comprising an internal spring and a slidable stem extending through the central axis, the slidable stem being in forward-biased mechanical communication with the internal spring;

a support plate rotabably mounted in front of the surface panel about the slidable stem;

a control body mounted to the slidable stem, the control body being rotationally fixed to the support plate and slidable relative thereto, the control body comprising a primary grip extending about at least a portion of the slidable stem and radially outward therefrom;

a central projection disposed radially inward from the primary grip, the central projection defining an axially fixed stop surface disposed forward from the control body; and a spacing stake extending rearward from the central projection through the control body toward the surface panel.

12. The cooking appliance of claim 11, further comprising an external spring disposed between the support plate and the control body, the control body being in forward-biased mechanical communication with the external spring.

13. The cooking appliance of claim 11, wherein the primary grip comprises a domed segment tapered forward and radially inward toward the central projection.

14. The cooking appliance of claim 11, wherein the spacing stake is one stake of a plurality of spacing stakes extending rearward from the central projection and circumferentially spaced apart about the rotation axis.

15. The cooking appliance of claim 14, wherein the support plate defines a front indentation receiving the external spring.

16. The cooking appliance of claim 14, wherein each spacing stake of the plurality of spacing stakes is fixed to the support plate to rotate therewith.

17. The cooking appliance of claim 11, wherein the control body comprises a center cap disposed radially inward from the primary grip and behind the central proj ecti on.

18. The cooking appliance of claim 17, wherein the central projection defines a rear recess receiving the center cap therein.

19. The cooking appliance of claim 17, wherein the center cap defines a keyed slot matched to the slidable stem to be rotated thereby, the slidable stem being received within the keyed slot.

20. The cooking appliance of claim 11, wherein the support plate defines a rear contact surface disposed on the surface panel and a rear gapped surface spaced apart from the surface panel radially outward from the rear contact surface, and wherein the spacing stake comprising a mounting foot disposed between the rear contact surface and the surface panel.

* * * * *